United States Patent [19]

Burns

[11] Patent Number: 4,889,321

[45] Date of Patent: Dec. 26, 1989

[54] APPARATUS FOR ROTATABLY MOUNTING A WINCH WITHIN AN ENCLOSURE

[75] Inventor: Russell W. Burns, Farmers Branch, Tex.

[73] Assignee: Concord Industries, Inc., Addison, Tex.

[21] Appl. No.: 202,515

[22] Filed: Jun. 6, 1988

[51] Int. Cl.[4] ..... B66D 1/00

[52] U.S. Cl. ..... 254/332; 116/173

[58] Field of Search ..... 254/329, 332; 116/173, 116/174; 52/720, 111, 114

[56] References Cited

U.S. PATENT DOCUMENTS

| | | | |
|---|---|---|---|
| 756,989 | 4/1904 | Suhr . | |
| 964,035 | 7/1910 | Lombard . | |
| 1,048,291 | 12/1912 | Buckley . | |
| 1,554,758 | 9/1925 | Post . | |
| 2,440,500 | 4/1948 | Ellis | 116/173 |
| 2,507,623 | 5/1950 | Diaz . | |
| 2,530,654 | 11/1950 | Ellis | 116/173 |
| 3,952,695 | 4/1976 | Vollstedt | 116/173 |
| 4,236,618 | 12/1980 | West | 192/8 R |
| 4,371,147 | 2/1983 | Ridgway | 254/329 X |
| 4,413,713 | 11/1983 | West | 192/8 R |
| 4,603,652 | 8/1986 | Thibault et al. . | |

OTHER PUBLICATIONS

Flagpole of Distinction, Automatic Flagpole Co., 3/1985.

*Primary Examiner*—Stuart S. Levy
*Assistant Examiner*—Katherine Matecki
*Attorney, Agent, or Firm*—Harold E. Meier

[57] ABSTRACT

An apparatus for rotatably mounting a winch within an enclosed housing wherein the apparatus comprises a housing with an access opening, a winch located in the housing, first and second platforms, means for securing the second platform in order to prevent rotation, means for detachably mounting the winch to the second platform, and coupling means for attaching the first and second platforms in a manner such that the second platform rotates with respect to the first platform.

8 Claims, 3 Drawing Sheets

APPARATUS FOR ROTATABLY MOUNTING A WINCH WITHIN AN ENCLOSURE

TECHNICAL FIELD

The present invention relates to an apparatus for rotatably mounting a winch within an enclosed housing for repair and/or removal and in particular to a winch detachably secured to a rotating platform within a flagpole.

BACKGROUND OF THE INVENTION

In many commercial industries, and particularly the flagpole industry, it is necessary to utilize winches in an enclosed housing or compartment. As these winches become obsolescent, they are in need of frequent repair and/or replacement. In many instances, such repair or replacement is a time-consuming, difficult and expensive proposition.

In the past, such repair or replacement has been hampered due to space limitations and the lack of maneuverability of the winch.

Additionally, many of the winches of the prior art such as is described in U.S. Pat. No. 4,236,618 require the flagpole to have an opening drilled in the side of the flagpole in order to insert a crank in the winch for raising and lowering the flag. This presents two problems: (1) the opening is unsecured and an object may be inserted and the flag lowered and stolen, and (2) the opening provides a potential weak spot in the pole.

The present apparatus for rotatably mounting a winch within an enclosed housing, however, is an efficient, labor-saving and inexpensive improvement over those of the prior art. The present apparatus allows one to rotate a winch and remove it from an enclosed housing with a minimum of effort and in a limited space. This is especially true in the flagpole industry since the present invention allows one to repair or replace a winch without performing an intricate repair operation in the limited confines of the flagpole.

The present invention also allows one to rotate the winch towards the access door for insertion of the crank and thus eliminates the need for an opening in the side of the flagpole with its resulting security risk and potential weakness.

Thus, the present apparatus and method provides a technological improvement and economic advantage over past traditional practices and offers advantages not disclosed by the prior art.

SUMMARY OF THE INVENTION

The present invention provides an apparatus that is efficient, labor-saving, relatively inexpensive to manufacture and yet provides a means of performing what was a difficult, time-consuming and expensive task.

Although the apparatus of the present invention can be utilized in many different industries, it is particularly useful in the flagpole industry.

The apparatus of the present invention comprises a housing with an access opening of sufficient size to allow a winch to enter and exit the housing. Additionally, such housing normally has a covering with a locking mechanism that fits over the opening to prevent unauthorized access to the interior of the housing. The winch of the present invention is any conventional or commercially available winch, such as, for example, the winch disclosed in U.S. Pat. No. 4,236,618. The apparatus further comprises a first platform, a second platform, means for securing the second platform to prevent its rotation, means for detachably mounting the winch to the second platform and coupling means for attaching the first and second platforms in a manner such that the second platform rotates with respect to the first platform.

The means for securing the second platform is any conventional commercially available device, but in at least one embodiment of the invention comprises a threaded bolt extending through the second platform, and threaded into an opening in the first platform. The mounting means, likewise, is any conventional commercially available device, but in at least one embodiment of the invention comprises a plurality of threaded bolts extending through an aperture in the lower spacer bars of the winch and threaded into openings in the second platform. The coupling means also is any conventional commercially available device but in at least one embodiment of the invention comprises a journal pinshaft having an upper smooth and lower threaded portion.

The apparatus of the present invention may be made of any suitable type material, however, in at least one embodiment of the invention the material is metal.

The apparatus of the present invention has numerous advantages over the prior art. Other embodiments and variations of the apparatus and method are discussed in the following Detailed Description of the Invention.

BRIEF DESCRIPTION

A more complete understanding of the invention and its advantages will be apparent from the Detailed Description taken in conjunction with the accompanying drawings in which.

DETAILED DESCRIPTION

Figure 1:
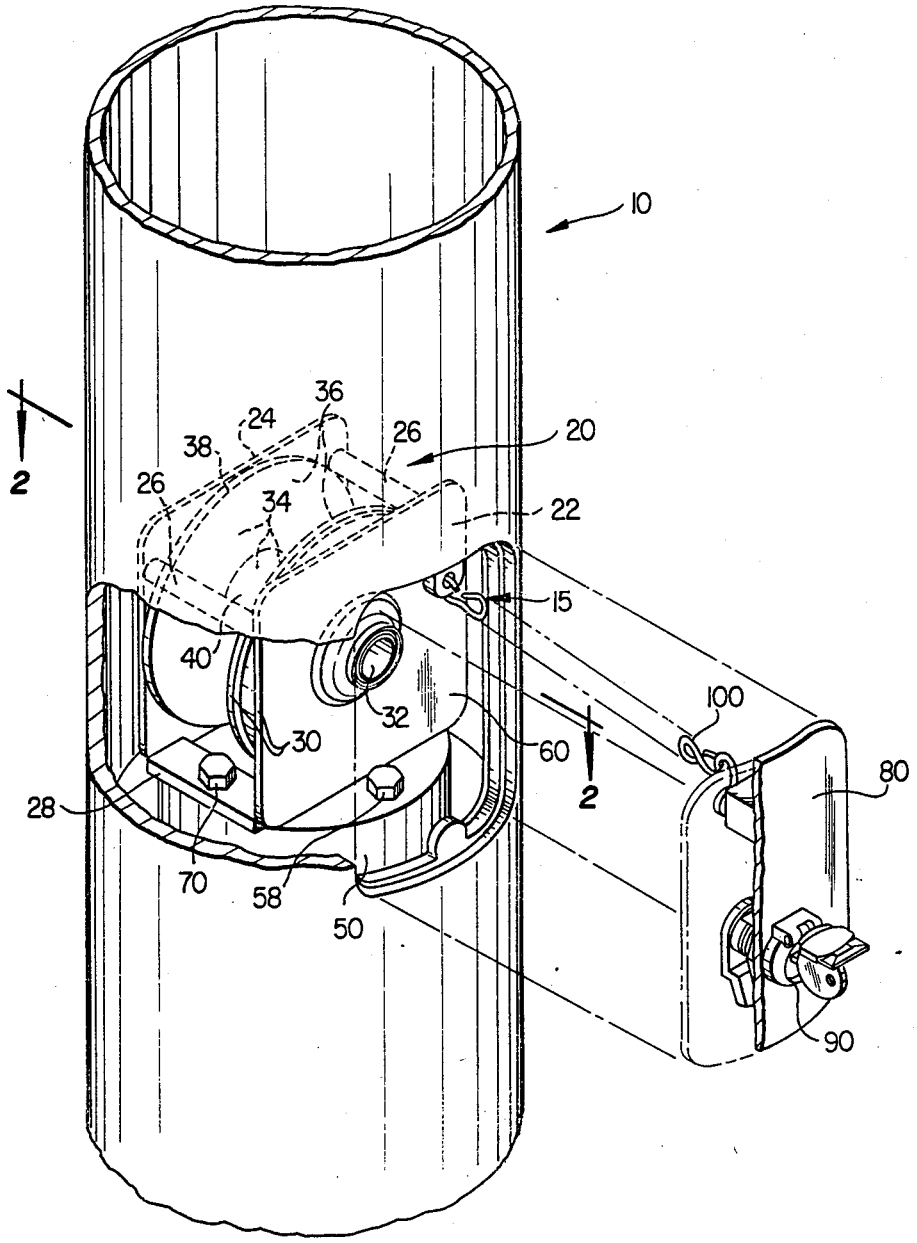
FIG. 1 is a perspective view of the apparatus illustrating the winch mounted on the second platform in the housing and the covering of the housing opening.

FIG. 1 discloses an industrial housing 10 with an opening 15 and a winch 20 located therein. Although it is understood that the present apparatus can be utilized in any industry using a winch in an enclosed housing, in at least one embodiment of the invention the housing 10 is a flagpole, usually cylindrical in shape and of either a fiberglass or metal construction.

While the opening 15 in FIG. 1 is rectangular in shape, any shape opening 15 may be utilized as long as it is of sufficient size to allow the winch 20 to be rotated and removed through the opening 15. The opening 15 is located so as to provide easy access to the winch 20 mounted in the interior of the housing 10.

The winch 20, located in the interior of the housing 10, is any conventional commercially available winch. Winches are well known in the art, see, e.g., U.S. Pat. No. 4,236,618, and as such the winch 20 is only superficially described in the specification herein.

Most conventional winches 20 have front and rear plates 22 and 24 located in parallel alignment with spacer bars 26 and 28 connecting the front and rear plates 22 and 24. Additionally, such winches 20 require a torque transmission and blocking device 30 usually with a suitable brake and clutch mechanism. (Not shown.) Additionally contained in most conventional winches 20 are a hollow drive shaft 32 and a cable drum 34 consisting of end flanges or discs 36 and a barrel 40. The cable drum usually has any type of commercially available cable (not shown) and is usually attached in a manner that allows it to hoist whatever object is attached to the cable such as, for example, a flag.

Although any conventional spacer bars 26 and 28 are utilized in the winch 20, in the present apparatus the lower spacer bars 28 have an aperture in them of sufficient size and location to enable a mounting means 70 to extend through the spacer bars 28 and into the second platform 50 for mounting the winch 20 on the second platform 50. In at least one embodiment of the invention the mounting means 70 comprises threaded bolts that extend through the lower spacer bar 28 and are threaded into the rotating second platform 50.

Also shown in FIG. 1 is the securing means 58 that extends through the second platform 50 and into the stationary first platform 60. Such securing means prevents the second platform 50 from rotating. Although the securing means 58 is any commercially available means, in at least one embodiment of the invention the securing means 58 comprises a threaded bolt.

The cover door 80 of FIG. 1 has a locking mechanism 90 and a security means 100 and is at least the same size as the opening 15. The covering 80 prevents access to the interior of the housing 10 through the opening 15. Additionally, it prevents the natural elements, such as wind and rain, from entering the housing 10 and hastening the obsolescence of the winch 20 and rotating apparatus. Although any type of locking mechanism 90 is used with the cover door 80, in at least one embodiment of the invention the locking mechanism 90 is a simple latch key. Additionally, any security means 100 is used to secure the cover door 80 to the housing 10, but in at least one embodiment of the invention, it is a link chain with hooks at both ends.

Figure 2:
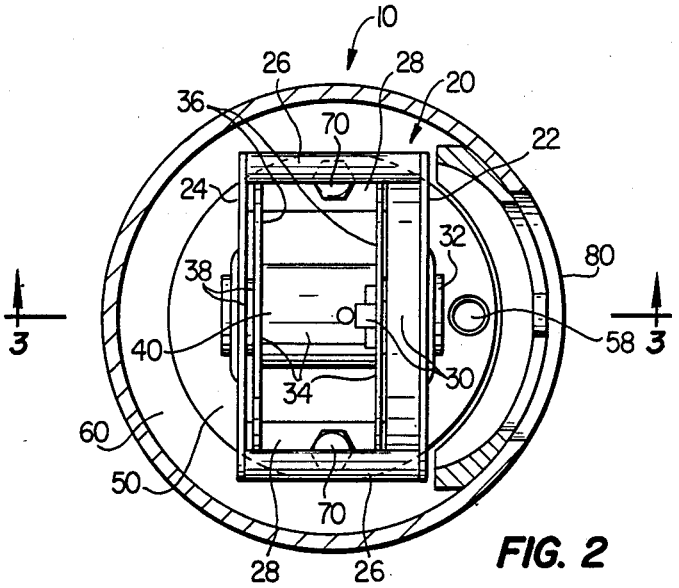
FIG. 2 is a cross-section view of FIG. 1 along the line 2—2.

FIG. 2 is a cross-section view of the apparatus from above the winch 20. It more clearly illustrates the possible placement of the mounting means 70 and the securing means 58 in relationship to the rotating second platform 50. The rotating second platform 50 disclosed by FIG. 2 is smaller than the stationary first platform 60. The stationary first platform 60 is attached to the housing 10 and although any means of attachment is available, in one embodiment of the invention, the second platform 60 is welded to the interior surface of the housing 10.

Also revealed in FIG. 2 are the additional components of the winch 20 described hereinbefore. Note once again that the mounting means 70 extends through the lower spacer bars 28 and into the rotating second platform 50.

The securing means 58 of FIG. 2 is located in a position for easy access and removal in order to rotate the second platform 50 and to remove the mounting means 70. This arrangement is better illustrated in FIG. 3.

Figure 3:
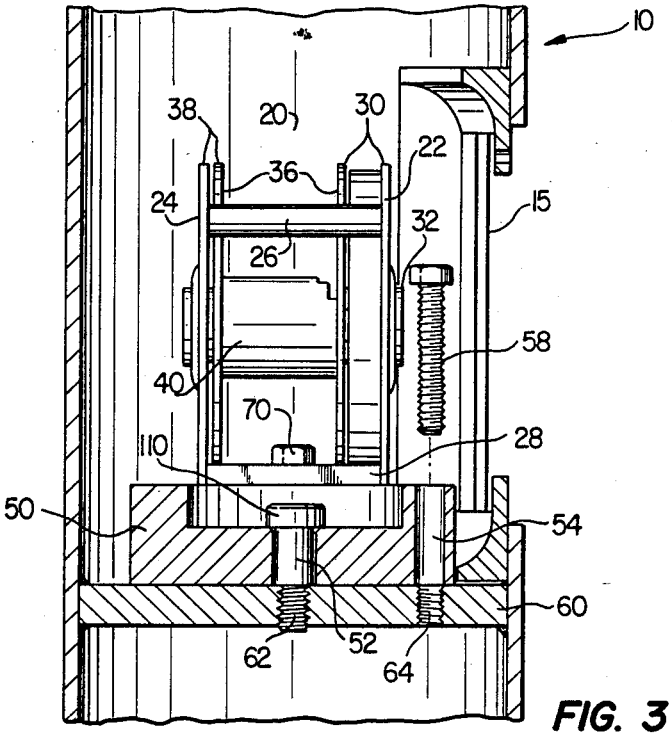
FIG. 3 is a cross-section view of FIG. 2 along the line 3—3.

FIG. 3, a sectional view taken along the line 3—3 of FIG. 2, reveals that the covering 80 has been removed and the opening 15 now allows access into the interior of the housing 10. The securing means 58 in FIG. 3 has been removed and allows the second platform 50 to freely rotate either clockwise or anti-clockwise. Again, in one embodiment of the invention, the securing means 58 is a threaded bolt.

FIG. 3 also illustrates the peripheral smooth opening 54 in the second platform 50 through which the securing means 58 extends, as well as, the matching threaded opening 64 in the first platform 60 into which the securing means 58 is threaded. When the securing means 58 is extended and threaded into the threaded opening 64 of the first platform 60, the second platform 50 cannot be rotated. After its removal, the second platform 50 is freely rotatable.

Shown for the first time in FIG. 3 is the coupling means 110 that attaches the second and first platforms, 50 and 60. The second platform 50 freely rotates about the coupling means 110. The coupling means 110 is any conventional commercially available device but in at least one embodiment of the invention, is a journal pinshaft, having a smooth upper surface and threaded lower surface.

The coupling means 110 extends through the smooth central opening 52 of the second platform 50 and is threaded into the central threaded opening 62 of the stationary first platform 60. Thus the smooth upper surface of the coupling means 110 corresponds to the smooth surface of the central opening 52 of the second platform 50. This allows the second platform 50 to freely rotate about the coupling means 110 with respect to the first platform 60.

FIG. 3 discloses once again that the mounting means 70 extends through the lower spacer bars 28 and into the rotating second platform 50.

Figure 4:
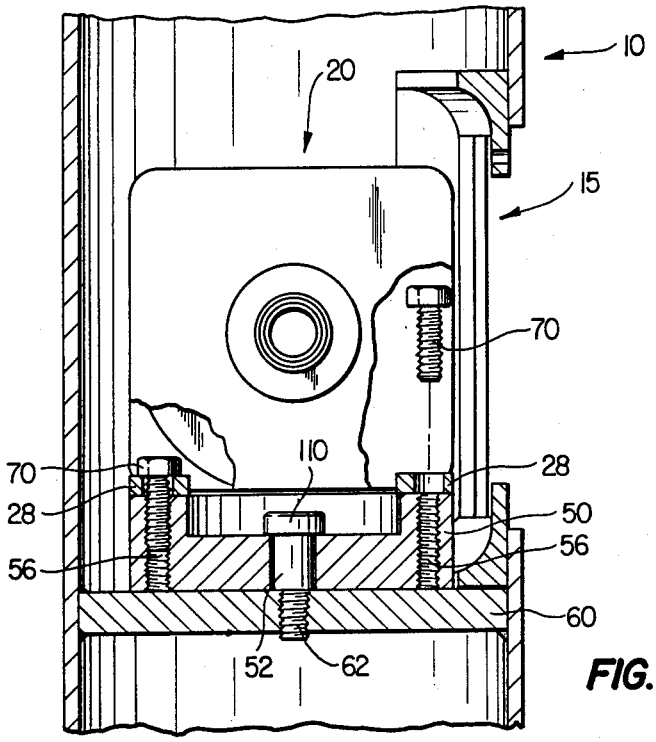
FIG. 4 is a perspective view of the apparatus revealing the removal of the mounting means.

FIG. 4 shows the winch 20 after rotation and removal of the covering 80 and securing means 58. The mounting means 70 extends into the peripheral openings 56 of the platform 50. In FIG. 4, the first of a plurality of mounting means 70 is removed from the peripheral openings 56 of the second platform 50. Note that the mounting apertures in the spacing bars 28 are smooth, whereas the openings 56 in the rotating second platform 50 are, in one embodiment of the invention, threaded. In at least one embodiment of the invention the mounting means 70 is a threaded bolt. The coupling means 110 of FIG. 4 is again shown as having a smooth upper half that fits into the smooth opening 52 of the rotating second platform 50 and a threaded lower half that fits into the central threaded opening 62 of the stationary first platform 60.

Figure 5:
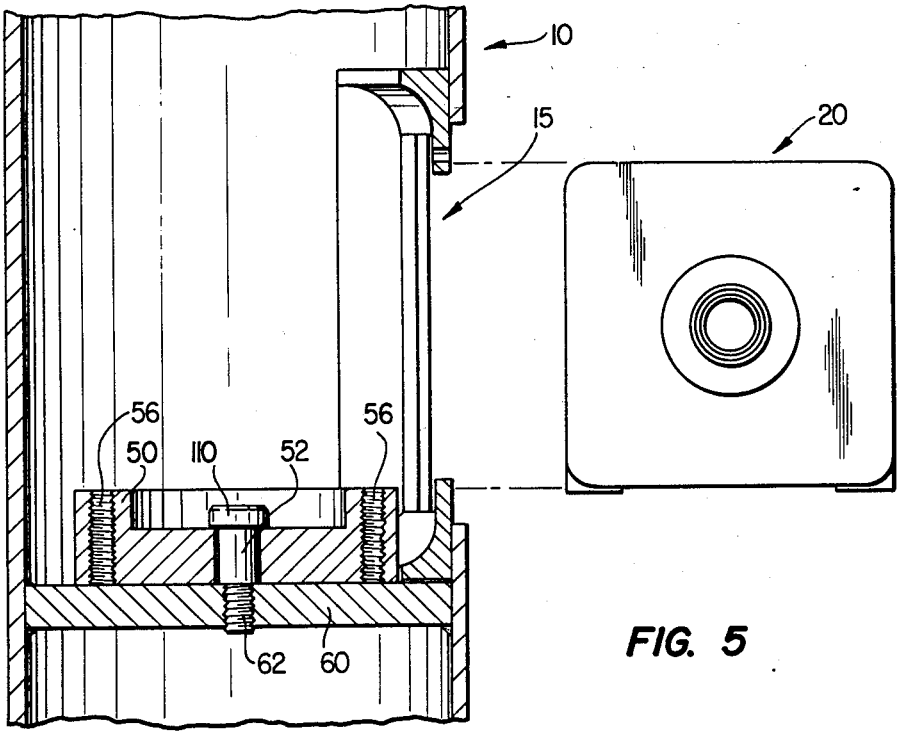
FIG. 5 is a perspective view of the apparatus revealing the complete removal of the winch from the interior of the housing.

FIG. 5 illustrates the apparatus after the complete removal of all of the mounting means 70 and of the securing means 58. Indeed FIG. 5 shows that the winch 20 has been totally removed from the housing 10 via the opening 15.

While certain embodiments of the present invention have been described in detail herein and shown in the accompanying drawings, it will be evident that various further modifications are possible without departing from the scope of the invention.

I claim:

1. An apparatus for a rotatably mounting a winch within a flagpole comprising:

a housing comprising a portion of said flagpole having an access opening therein, said access opening being of sufficient size to allow removal of said winch from within said housing;

a first platform comprising a disc-like plate attached to the housing in a fixed position with a central opening and at least one peripheral opening;

a second platform comprising a disc-like rotatable plate having a central smooth-faced opening and a plurality of peripheral openings with at least one such peripheral opening extending completely through said platform;

a winch mounted to the second platform;

means for securing the second platform against rotation with reference to the first platform comprising a fastener extending through one of said peripheral openings of the second platform and into the peripheral opening of the first platform;

means for detachably mounting the winch to said second platform; and coupling means for attaching the first and second platforms in such a manner that the second platform rotates with respect to the first platform.

2. An apparatus for rotatably mounting a winch in accordance with claim 1 wherein the housing further comprises a covering with a security means and locking mechanism hat fits over the opening for preventing access to the winch.

3. An apparatus for rotatably mounting a winch in accordance with claim 1, wherein the means for mounting the winch to the second platform further comprises a plurality of fasteners that extend through the winch and are threaded into the second platform.

4. An apparatus for rotatably mounting a winch in accordance with claim 1, wherein the coupling means further comprises a journal pinshaft having an upper smooth surface and a lower threaded surface extending through the central opening of the second platform and threaded into the central opening of the first platform.

5. An apparatus for rotatably mounting a winch within a housing formed as a part of a flagpole, comprising:

a flagpole having an access opening of sufficient size to allow entry into and removal of a winch from a housing portion thereof;

an access opening cover;

a locking mechanism for securing said access opening cover and preventing access to said winch;

a disc-like first platform attached to the housing portion having a central threaded opening and at least one peripheral threaded opening;

a disc-like rotatable second platform rotatably mounted to the first platform having a central smooth-faced opening and a plurality of peripheral openings with at least one such opening extending completely through the platform;

a winch mounted to the second platform, said winch having a plurality of low®r spacer bars with mounting apertures;

means extending through one of said peripheral openings of said second platform and into said peripheral opening of said first platform for securing said second platform against rotation relative to said first platform;

means for detachably mounting the winch to the second platform; and coupling means for attaching the first and second platforms in a manner such that the second platform rotates with respect to the first platform.

6. An apparatus for rotatably mounting a winch in accordance with claim 5, wherein the means for securing the second platform further comprises a threaded bolt extending through the peripheral opening of the second platform and threaded into the peripheral opening of the first platform.

7. An apparatus for rotatably mounting a winch in accordance with claim 5, wherein the means for mounting the winch to the second platform further comprises a plurality of fasteners extending through the mounting apertures of the lower spacer bars of the winch and threaded into the peripheral openings of the second platform.

8. An apparatus for rotatably mounting a winch in accordance with claim 5, wherein the coupling means further comprises a journal pinshaft having an upper smooth surface and a lower threaded surface extending through the central smooth opening of the second platform and threaded into the central threaded opening of the first platform.

* * * * *

UNITED STATES PATENT AND TRADEMARK OFFICE

CERTIFICATE OF CORRECTION

PATENT NO. : 4,889,321

DATED : December 26, 1989

INVENTOR(S) : Russell W. Burns

It is certified that error appears in the above-identified patent and that said Letters Patent is hereby corrected as shown below:

Column 5, line 21, change "hat" to "that".
Column 6, line 10, change "low R r" to "lower".

Signed and Sealed this

Fifth Day of March, 1991

*Attest:*

HARRY F. MANBECK, JR.

*Attesting Officer*

*Commissioner of Patents and Trademarks*